United States Patent [19]

Wagenknecht et al.

[11] Patent Number: 4,755,713

[45] Date of Patent: Jul. 5, 1988

[54] ARTICLE SUPPORTING STUD AND CRT FACE PANEL EMPLOYING SAME

[75] Inventors: Arthur J. Wagenknecht, York, Pa.; John R. Anderson, Naugatuck, Conn.; Joseph A. Guzikowski, York, Pa.

[73] Assignee: GTE Products Corporation, Stamford, Conn.

[21] Appl. No.: 902,345

[22] Filed: Aug. 29, 1986

[51] Int. Cl.[4] ..... H01J 29/07

[52] U.S. Cl. ..... 313/406

[58] Field of Search ..... 313/402, 404, 406, 407, 313/408

[56] References Cited

U.S. PATENT DOCUMENTS

| | | | |
|---|---|---|---|
| 3,379,913 | 4/1968 | Gannoe | 313/402 |
| 4,387,321 | 6/1983 | Gijrath et al. | 313/406 |

FOREIGN PATENT DOCUMENTS

| | | | |
|---|---|---|---|
| 54-39569 | 3/1979 | Japan | 313/402 |
| 1095268 | 5/1984 | U.S.S.R. | 313/402 |

*Primary Examiner*—David K. Moore
*Assistant Examiner*—Sandra L. O'Shea
*Attorney, Agent, or Firm*—William H. McNeill

[57] ABSTRACT

A corner stud for a color CRT face panel comprises a hollow body having two juxtaposed frusto-conical portions, one closed and one opened. The opened end is sealed into the corner formed by two adjacent walls of the face panel.

4 Claims, 2 Drawing Sheets

ARTICLE SUPPORTING STUD AND CRT FACE PANEL EMPLOYING SAME

TECHNICAL FIELD

This invention relates to studs for inclusion in cathode ray tube (CRT) face panels.

BACKGROUND ART

Face panels for some cathode ray tubes, particularly those used to display images in color, include a frontal portion having a peripheral wall upstanding therefrom. While the frontal or viewing portion generally comprises a spherical or cylindrical section, such a construction defines a substantially flat plane and, as used herein, the term "substantially flat plane" is intended to include such embodiments. The upstanding wall of such face panels has a plurality of studs retained therein for supporting a shadow mask or color selection electrode. In the past, such tubes generally employed three or four studs spaced 120° or 90° apart, respectively. The studs were retained in substantially flat portions of the walls. One such stud, which has frequently been employed, is shown in U.S. Pat. No. 3,379,913.

Newer styles of CRT's, such as those used for color television receivers, have more nearly square corners than the older types. It is desirable in these newer CRT's to have an article supporting stud directly in these corners. To date, the studs employed have been solid. They have been made from wire or rod material on lathe type equipment or made on cold heading machines. Such studs are expensive to manufacture. Further, to insert these studs into previously formed glass panels the stud must be heated to high temperature; i.e., in the neighborhood of 1350° C., usually by R.F. heating. Insertion time into the glass is long, up to 60 seconds.

The exposed end of the stud gets very hot while it is difficult to heat the end for glass penetration.

DISCLOSURE OF THE INVENTION

It is, therefore, an object of this invention to obviate the disadvantages of the prior art.

It is another object of the invention to enhance CRT face panels employing studs.

Yet another object of the invention is the provision of face panel studs having even heating qualities.

Still another object of the invention is the provision of a stud for corner mounting which is relatively inexpensive to manufacture. Another object is to reduce the insertion time from up to 60 seconds to about 24 seconds.

These objects are accomplished, in one aspect of the invention, by the provision of a stud which comprises a hollow body having a substantially uniform wall thickness. The wall is symmetrically arrayed about a longitudinal axis. The body includes a shoulder having a given diameter which extends normal to the longitudinal axis. A frusto-conical head axially projects from the shoulder in a first direction. The head has a base and a summit with the base being integral with the shoulder and having a diameter less than the given diameter. A frusto-conical skirt portion axially projects from the shoulder in a second direction opposite from said first direction. The skirt portion has a base and a summit with the base being integral with the shoulder and having a diameter equal to the given diameter.

This hollow body stud heats more evenly and inserts easier into the glass than solid corner studs. Further, since the stud can be manufactured by deep drawing techniques, it is less expensive.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
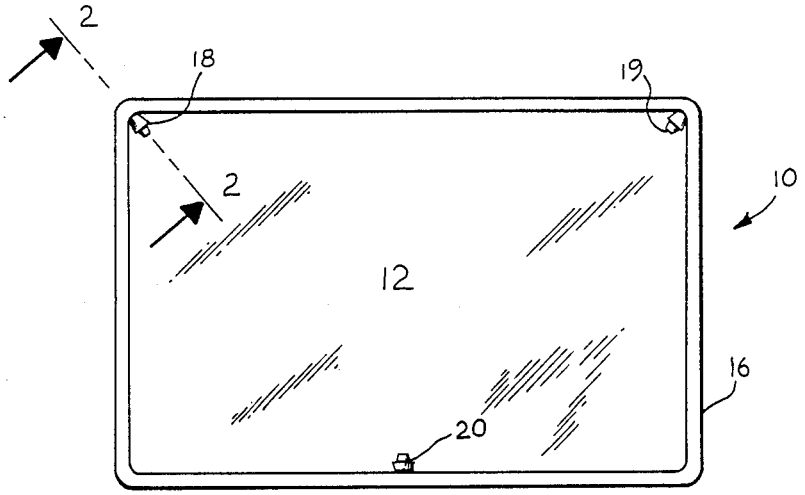
FIG. 1 is a diagrammatic plan view of a cathode ray tube face panel employing the invention.

Referring now to the drawings with greater particularity, there is shown in FIG. 1 a plan view looking into the open side of a CRT face panel 10 before the cathodoluminescent screen is disposed on the viewing surface 12 thereof. Surrounding the viewing surface 12 is an upstanding wall 16 having a plurality of article supporting studs 18, 19, and 20 embedded therein. The face panel 10 has substantially square corners 22 and the studs 18 and 19 are embedded in two of these corners. In the illustrated embodiment, the studs 18 and 19 are constructed in accordance with the teachings hererin. The stud 20 can be formed in accordance with the teachings of the above-mentioned U.S. Pat. No. 3,379,913.

Figure 2:
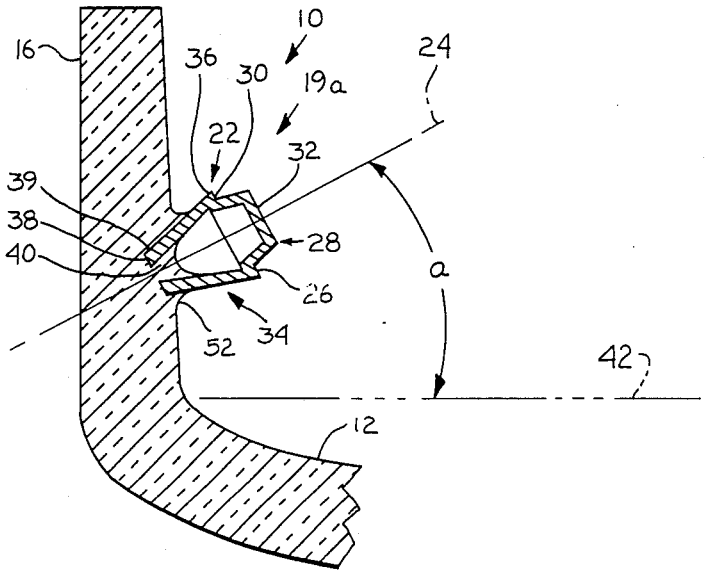
FIG. 2 is an elevational sectional view taken on the line 2—2 of FIG. 1.

One of the corner studs, e.g., 19 is shown in detail in FIG. 2. Stud 19 is formed from a suitable stainless steel alloy which can be oxidized to seal with the glass. Suitable materials include Number 4 Alloy, a nickel-chrome-iron material available from GTE Sylvania, Warren, Pa.; and 430 Ti stainless steel, a chrome-iron alloy produced by Allegheny Ludlum Steel Corp. Pittsburgh, Pa. The stud 19 comprises a hollow body 22 which has a substantially uniform wall thickness over most of its length with the wall being symmetrically arrayed about a longitudinal axis 24. A shoulder portion 26 has a given diameter, say, about 0.40", and extends normal to axis 24. A frusto-conical head 28 projects from the shoulder 26 and has a base 30 and a summit 32. The base 30 is integral with shoulder 26 and has a diameter less than the given diameter.

A frusto-conical skirt portion 34 axially projects from the shoulder 26 in a second direction opposite from the first direction and has a base 36 and summit 38. The base 36 is also integral with the shoulder 26 and has a diameter equal to the given diameter. The plane 40 of the skirt summit 38 is orthogonal to axis 24. The wall thickness is preferably about 0.030" throughout most of its length; however, the terminal portion 39 of skirt summit 38 is about 10% thicker, say 0.033". This feature greatly increases the holding power of the stud 19 (and stud **19*a*) by forming, in effect, an undercut into which the glass flows upon insertion of the stud. As noted, these hollow studs are formed by deep drawing which necessitates that the skirt sidewalls be parallel when formed. The frusto-conical skirt configuration is subsequently formed in a coning operation which thickens the terminal portions 39 (and 39*a* of stud 19*a*). The face panel 10 has a viewing surface 12 which defines a substantially flat plane 42. When the stud 19 is inserted in the glass of the side wall 16, the axis 24 makes an angle a with respect to the plane 42**. In a preferred embodiment, angle a is about 35°; however, it can be between 25° and 45°.

Figure 3:
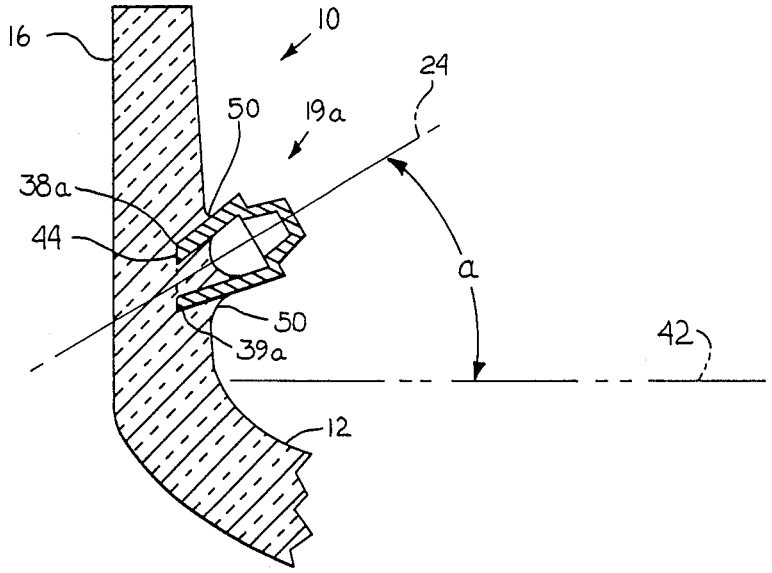
FIG. 3 is a view similar to FIG. 2 illustrating an alternate embodiment.

An alternate embodiment of the corner stud 19 is shown in FIG. 3. Therein, a stud 19*a* is substantially identical to stud 19 except that plane 44 of skirt summit 38*a* forms an angle of about 45° to 65° with the longitudinal axis 24. This construction provides that the skirt summit plane is substantially parallel to the surface of side wall 16.

An additional advantage in stud 19*a* derives from the insertion process. When the heated stud is inserted into the glass wall it is pushed in a distance farther than required and then partially withdrawn. The withdrawal operation pulls out some of the molten glass surrounding the stud and forms a fillet 50 thereabout. The angled summit 38*a* allows more leeway in this withdrawal operation to retain the air bubble contained within the hollow stud. Comparison of FIG. 3 with FIG. 2 will show this advantage; thus, if stud 19 is withdrawn too far, the lower edge 52 of summit 38 may leave the glass, allowing the release of the contained air bubble and destroying the fillet in that area. Such a consequence provides a very weak bond for the stud.

Studs constructed as described herein are easier to employ than the previously used solid corner studs. They are easier to heat and cheaper to manufacture.

While there have been shown and described what are at present considered to be the preferred embodiments of the invention, it will be apparent to those skilled in the art that various changes and modifications can be made herein without departing from the scope of the invention as defined by the appended claims.

We claim:

1. An article supporting stud for corner mounting in a cathode ray tube face panel, said stud comprising: a hollow body having a substantially uniform wall thickness, said wall being symmetrically arrayed about a longitudinal axis; a shoulder portion having a given diameter extending normal to said longitudinal axis; a frusto-conical head axially projecting from said shoulder portion in a first direction, said head having a base and a summit, said base being integral with said shoulder and having a diameter less than said given diameter; and a frusto-conical skirt portion axially projecting from said shoulder portion in a second direction opposite from said first direction, said skirt portion having a base and a summit, said base being integral with said shoulder and having a diameter equal to said given diameter and said skirt summit terminating in a plane wherein said plane forms an angle of about between 45° and 65° with said longitudinal axis.

2. The article supporting stud of claim 1 wherein the plane of said skirt summit forms an angle of about 55° with said longitudinal axis.

3. An article supporting stud for corner mounting in a cathode ray tube face panel, said stud comprising: a hollow body having a substantially uniform wall thickness, said wall being symmetrically arrayed about a longitudinal axis; a shoulder portion having a given diameter extending normal to said longitudinal axis; a frusto-conical head axially projecting from said shoulder portion in a first direction, said head having a base and a summit, said base being integral with said shoulder and having a diameter less than said given diameter; and a frusto-conical skirt portion axially projecting from said shoulder portion in a second direction opposite from said first direction, said skirt portion having a base and a summit, said base being integral with said shoulder and having a diameter equal to said given diameter, the terminal portion of said skirt summit having a thickness greater than said substantially uniform wall thickness.

4. The article supporting stud of claim 3 wherein said terminal portion of said skirt summit has a thickness about 10% greater than said substantially uniform wall thickness.

* * * * *